United States Patent [19]

Herrington

[11] Patent Number: 4,628,665

[45] Date of Patent: Dec. 16, 1986

[54] MODULAR INDEXING TABLE FOR A BOX LOADING SYSTEM

[75] Inventor: Fox J. Herrington, Holcomb, N.Y.

[73] Assignee: Mobil Oil Corporation, New York, N.Y.

[21] Appl. No.: 707,227

[22] Filed: Mar. 1, 1985

[51] Int. Cl.[4] ..... B65B 43/42

[52] U.S. Cl. ..... 53/252; 53/53; 53/250; 198/447

[58] Field of Search ..... 53/53, 564, 252, 251, 53/250, 249; 198/436, 445, 447, 451, 416, 427; 414/757, 781, 783

[56] References Cited

U.S. PATENT DOCUMENTS

| | | | |
|---|---|---|---|
| 2,804,961 | 9/1957 | Carter | 198/447 |
| 2,953,234 | 9/1960 | Abendschein | 198/447 |
| 3,122,231 | 2/1964 | Pence et al. | 198/358 |
| 3,144,119 | 8/1964 | Nigrelli et al. | 198/451 |

*Primary Examiner*—John Sipos
*Assistant Examiner*—Donald R. Studebaker
*Attorney, Agent, or Firm*—Alexander J. McKillop; Michael G. Gilman; Charles J. Speciale

[57] ABSTRACT

A box indexing table delivers a group of empty boxes from a main conveyor to a box loading machine. The loaded boxes are pushed onto a full box conveyor. Both the main conveyor and the full box conveyor extend completely across the table. The capacity of the loading equipment can be expanded in modular fashion by adding modular tables.

13 Claims, 16 Drawing Figures

MODULAR INDEXING TABLE FOR A BOX LOADING SYSTEM

BACKGROUND OF THE INVENTION

This invention relates to apparatus for loading cartons with articles and, more particularly, to an indexing table for such a system.

Machinery for folding and loading of thin, limp, sheet-type articles into boxes, is used, for example, in the packaging of plastic bags, such as trash bags, produce bags and sandwich bags. These plastic bags are folded and loaded into cartons which contain, for example, 75 or 150 bags for retail sale.

Box forming machinery is available and commonly has a high capacity of production. Similarly, the box closing machinery which is presently available has a high capacity. When a system for filling boxes is initially installed, the production requirements are quite often much less than the capacity of the box forming and closing machinery. Installation engineers are faced with the quandary of providing expensive box loading mechanisms which can operate up to the capacity of the box forming machines, or alternatively, providing less expensive box forming machines having only the capacity which is required. If the latter option is chosen, after a few years the requirements may increase beyond the capacity of the box loading equipment, thereby obviating the system.

It is desirable to provide modular box loading equipment which can be easily expanded by adding box loading equipment as needed to the system.

RELATED APPLICATIONS

Copending application Ser. No. 654,360, filed Sept. 26, 1984, "BAG FOLDING AND LOADING MACHINE HAVING IMPROVED SWATTER," Herrington describes a mechanism which folds a bag in thirds, then loads it directly into a carton. That application is incorporated by reference herein.

SUMMARY OF THE INVENTION

It is an object of the present invention to provide an indexing table for carton loading machines which are modular and which can be easily interconnected in the system with increased capacity.

It is another object of the present invention to provide an indexing table for bag loading machines which perform its functions reliably, has high durability, and minimal component failure.

In accordance with the present invention, an indexing table for box, or carton, loading machines has a main conveyor which transports empty boxes along the indexing table. This main conveyor can be extended by adding additional tables to the system in a modular expansion of the system. Empty boxes are diverted from the main conveyor onto an indexing conveyor which transports groups of boxes to the loading machine. After loading, the boxes are moved to a full box conveyor which extends completely along the table. This full box conveyor can be extended also by adding additional tables in modular fashion to increase the capacity of the system. In this manner a system of interconnected tables can be formed, each having the capability of servicing box loading machines of a given capacity. All of the machines are serviced by common box forming and box closing machines.

The foregoing objects, features and advantages of the invention will be better understood from the following more detailed description and appended claims.

SHORT DESCRIPTION OF THE DRAWINGS

FIG. 1 shows a carton loading system including a plurality of indexing tables in accordance with the present invention;

FIG. 2 schematically represents the indexing table of the present invention;

DESCRIPTION OF THE PREFERRED EMBODIMENT

Figure 1:
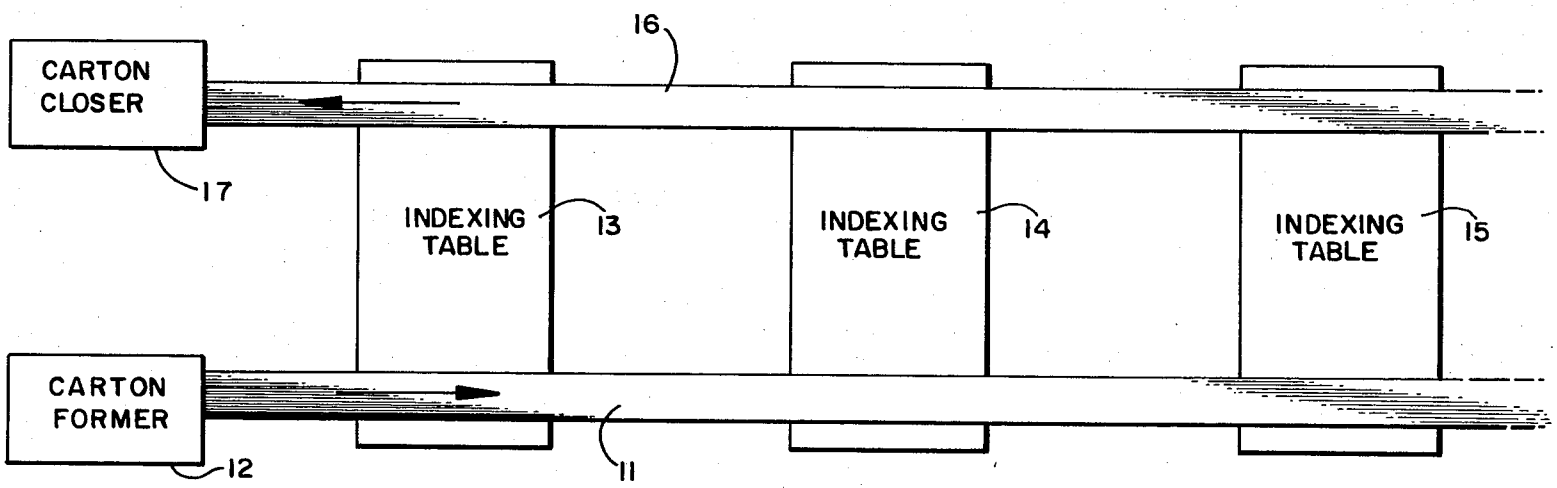

Referring to FIG. 1, a main conveyor 11 transports empty cartons from the carton-former 12 to a plurality of indexing tables 13, 14 and 15 of the present invention. The main conveyor 11 traverses each indexing table so that the indexing tables can be easily interconnected in modules and the capacity of the box-loading system can be expanded as required. In the exemplary embodiment, up to ten indexing tables can be fed from a common carton-forming machine.

Similarly, a full box conveyor 16 along across all of the indexing tables and feeds loaded boxes back to the carton closer 17.

Each indexing table includes means for sequentially pushing groups of boxes from the main line conveyor 11 and transporting them to loading machines on the indexing table. Each indexing table also includes means for merging the loaded boxes from the loading machines onto the full box conveyor 16 so that they can be returned to the carton closer.

Figure 2:
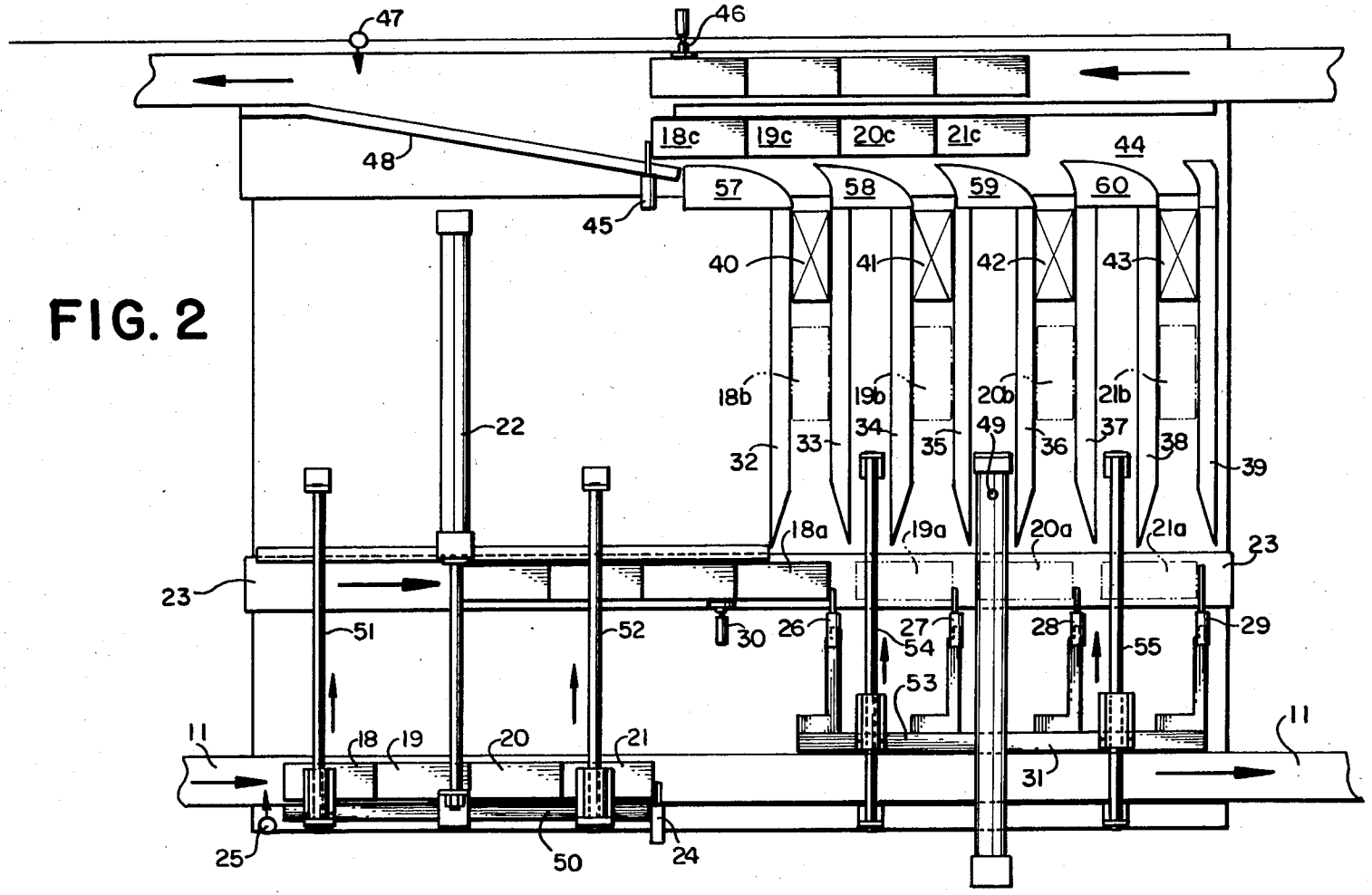

The indexing table is shown schematically in FIG. 2. Boxes 18–21 from the carton-forming machine are transported on the main conveyor 11 to a pusher which pushes a group of four boxes from the main line conveyor 11 onto an indexing conveyor 23. The pusher includes air cylinder 22 which operates the pusher plate 50. A blocking mechanism 24 retards movement of boxes along the main conveyor 11 until a group of four is assembled as sensed by the optical sensor 25. When a group of four is assembled, the pusher is actuated to move the group of boxes from the main line conveyor onto the indexing conveyor 23. The indexing conveyor 23 moves the boxes to a separator which includes blocking mechanisms 26, 27 and 28, a stop 29 and a squeezing mechanism 30 which momentarily retards the movement of the boxes so that the correct spacing is obtained. The blocking mechanisms 26–28 and squeezing mechanism 30 are selectively actuated in response to movement of the indexing conveyor 23 to obtain the proper box spacing as indicated by the dashed line positions **18*a*–21*a*. When this position is achieved, an indexer 31 turns the boxes and moves them between rails 32–39 to the index positions indicated at 18*b*–21*b*. A proximity detector located at 49** detects when the indexing plate is close to the proximity detector. This indicates when the index bar is in the index position.

Four loading machines 40–43 are provided for each indexing table. Each of the loading machines 40–43 is of the type shown in the above-mentioned Herrington application. When the boxes are full, the indexer 31 further moves the group of four cartons from the position shown at **18*b*–21*b* to the loading position under the machines 40–43. This pushes loaded cartons onto the full carton conveyor 44. Simultaneously, the boxes are turned to assume the positions indicated at 18***c*–21*c*. These boxes are merged into the line of full boxes, from other indexing tables.

The means for merging includes a blocking mechanism 45 and a squeezing mechanism 46. A photosensor 47 senses when the full box conveyor 44 is free of boxes so that the blocking mechanism 45 can release loaded boxes from the positions 18*c*–21*c* to merge them into the line of loaded boxes traveling on conveyor 44.

A rejector arm 48 is provided. The arm can be swung to the center of conveyor 44 to divert boxes from the indexing table so that they do not enter the full box conveyor line. This is sometimes necessary during a startup when boxes are initially not loaded correctly.

Figure 3A:
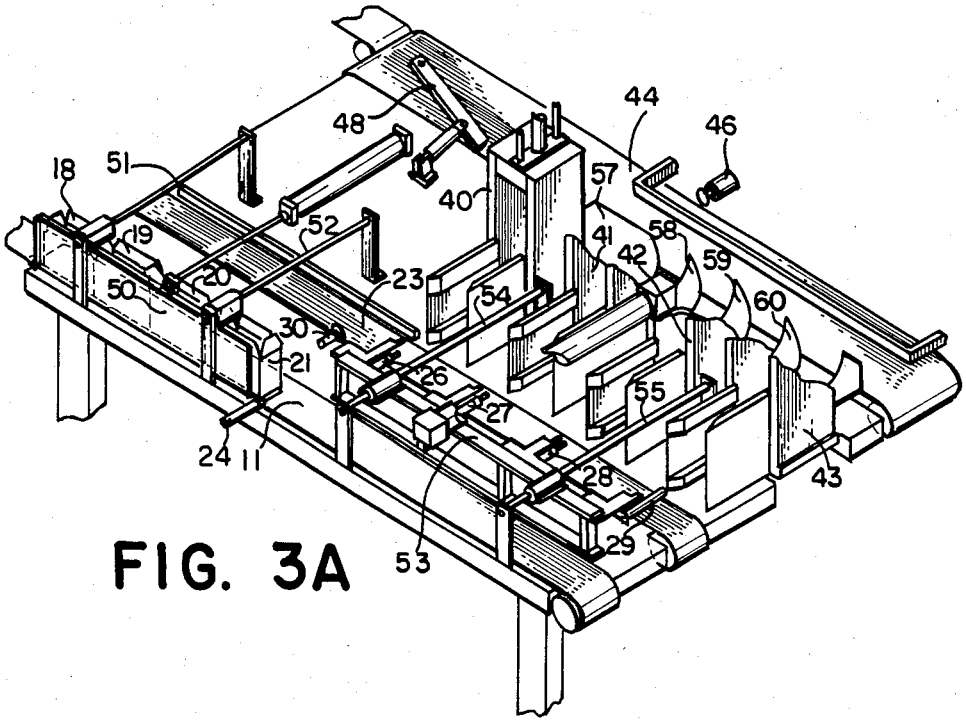
FIGS. 3A–3L depict the indexing table during a sequence of operations.

The operation of the indexing table of the present invention can be better understood with reference to FIGS. 3A–3L, which show perspective views of the indexing table during sequential stages of operation of the machine. As shown in FIG. 3A, the line of empty boxes on main conveyor 11 is stopped by the blocking mechanism 24 so that a group of boxes is accumulated.

Figure 3B:
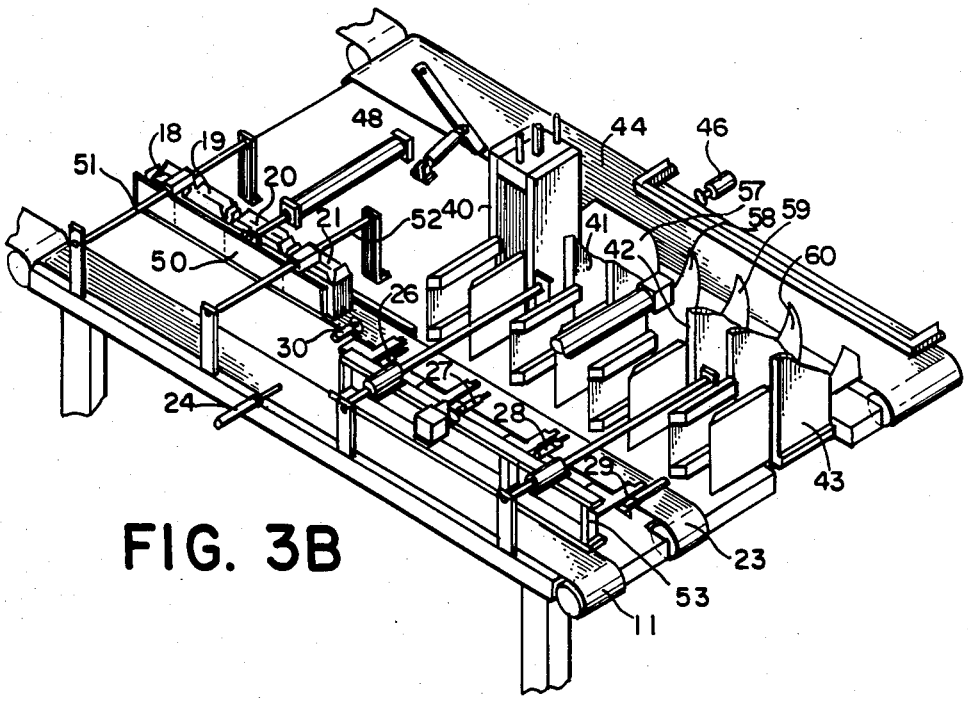

As shown in FIG. 3B, pusher plate 50, which runs on the rods 51 and 52, moves the group of boxes from the main conveyor 11 to the indexing conveyor 23.

Figure 3C:
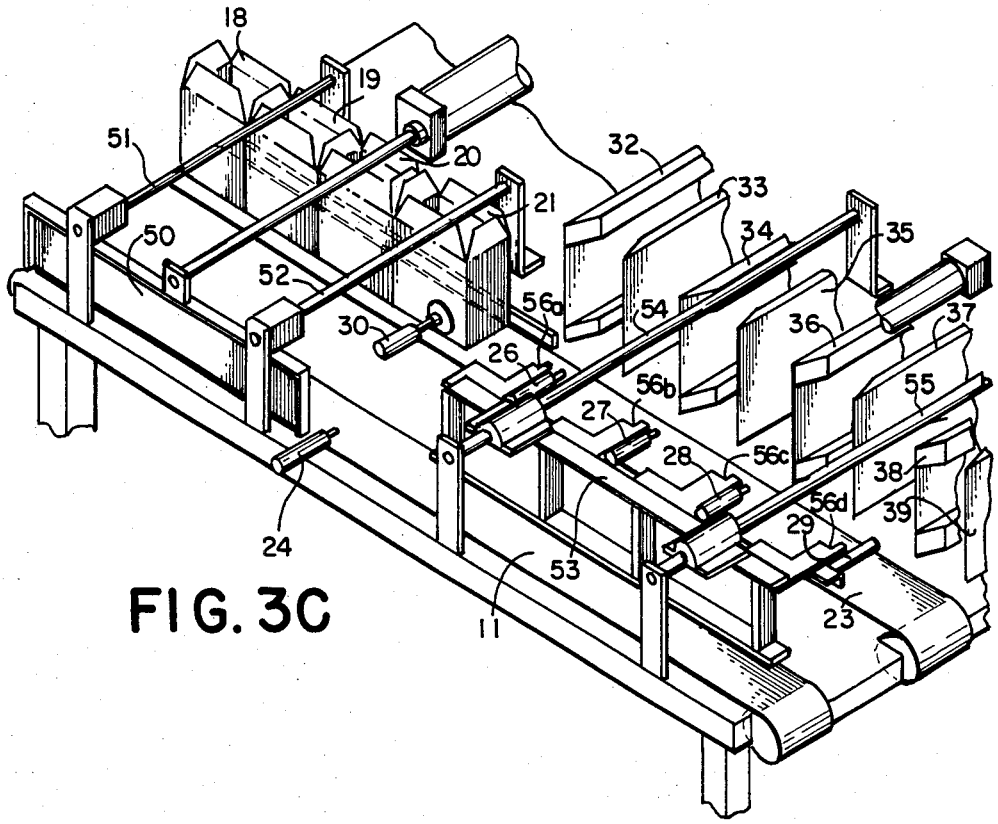
Figure 3D:
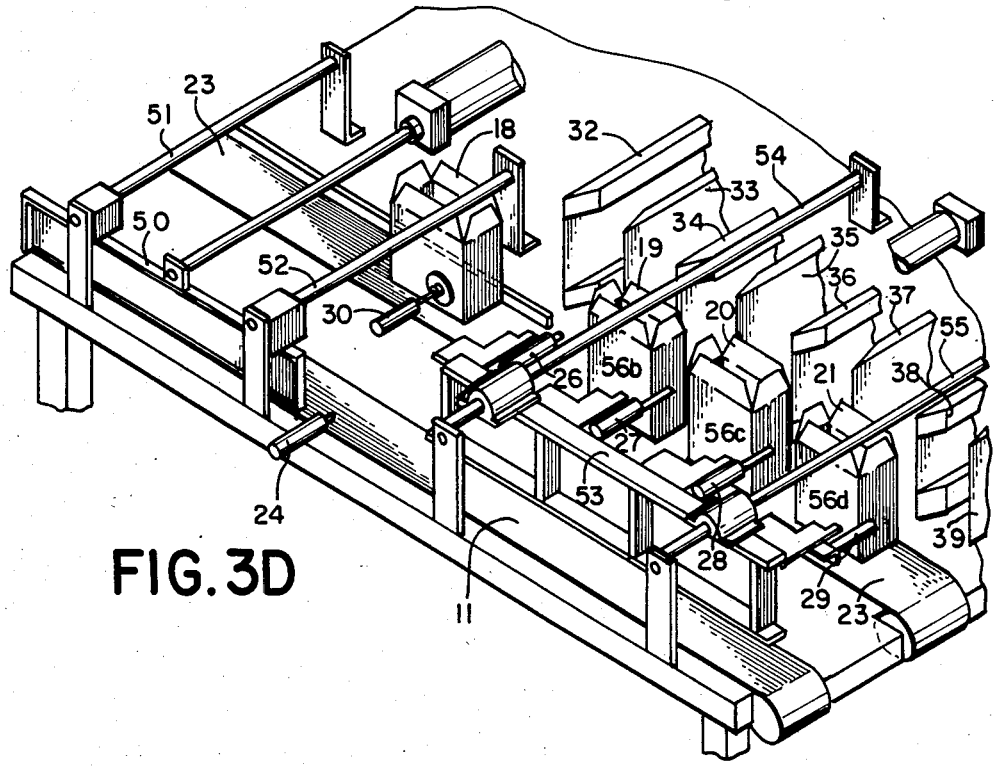

FIGS. 3C and 3D show the separation of the boxes by the stop 29, squeezing mechanism 30 and blocking mechanisms 26–28. The squeezing mechanism 30 holds the box long enough for the blocking mechanisms 26–28 to stop the boxes in front of the associated loading machine.

Figure 3E:
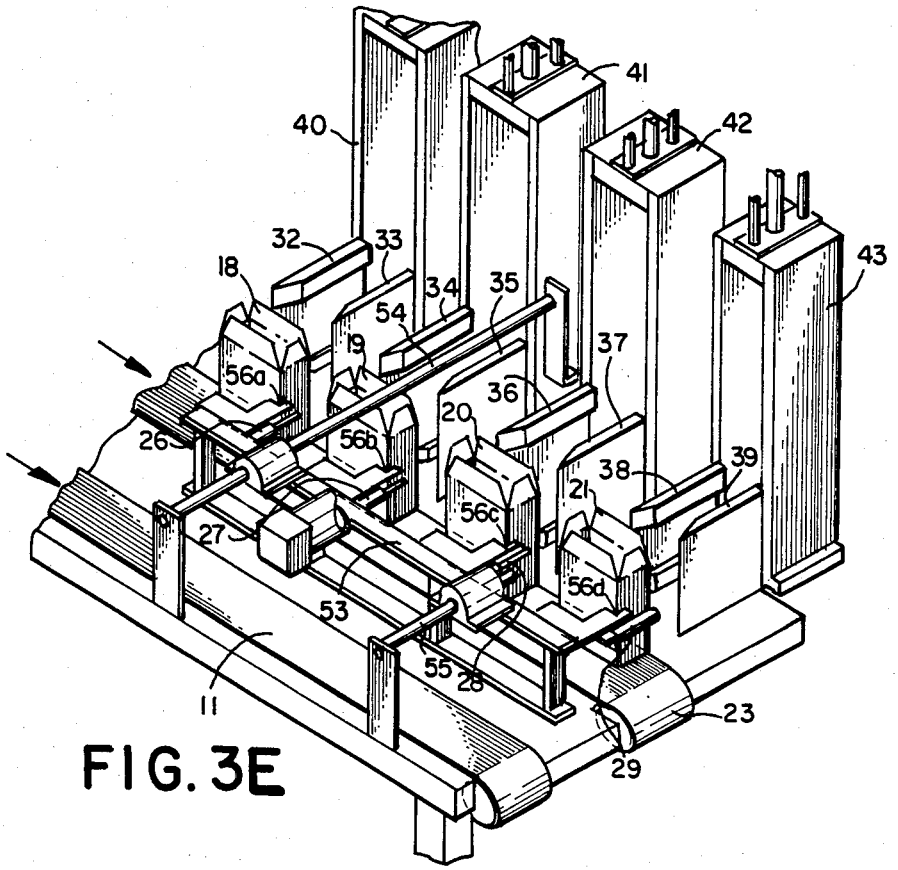
Figure 3F:
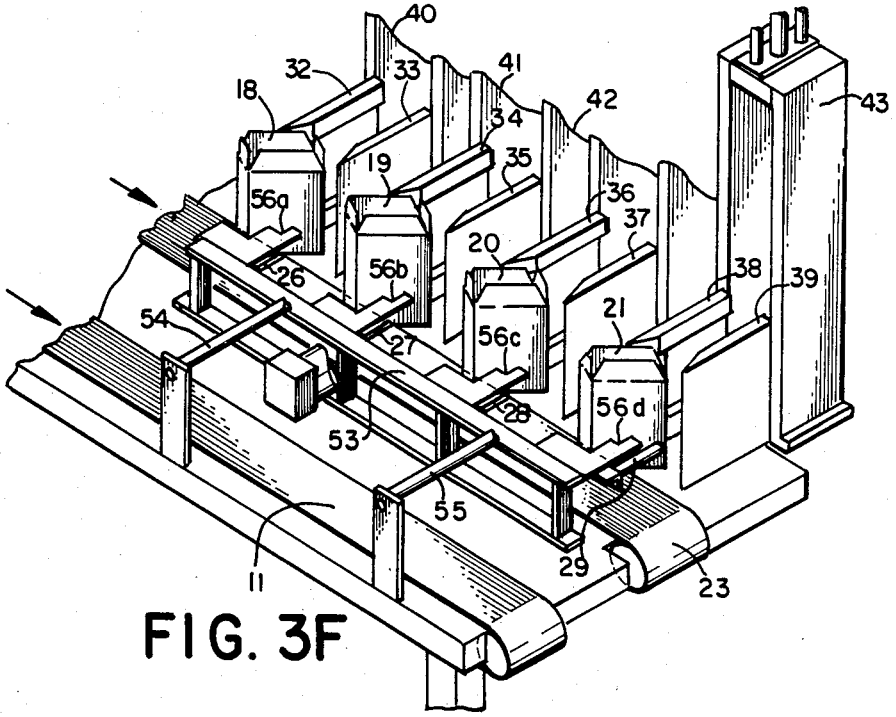
Figure 3G:
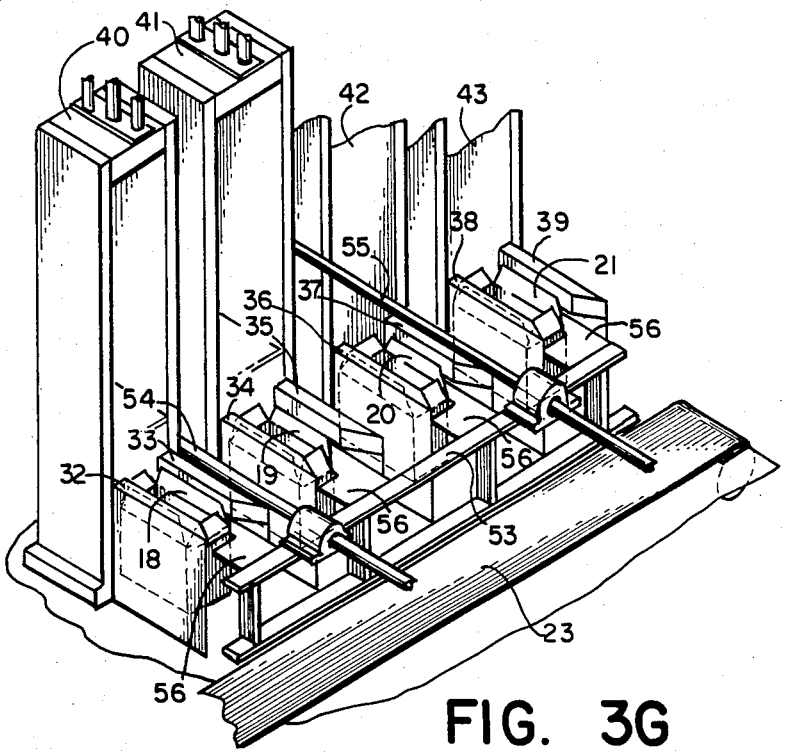
Figure 3H:
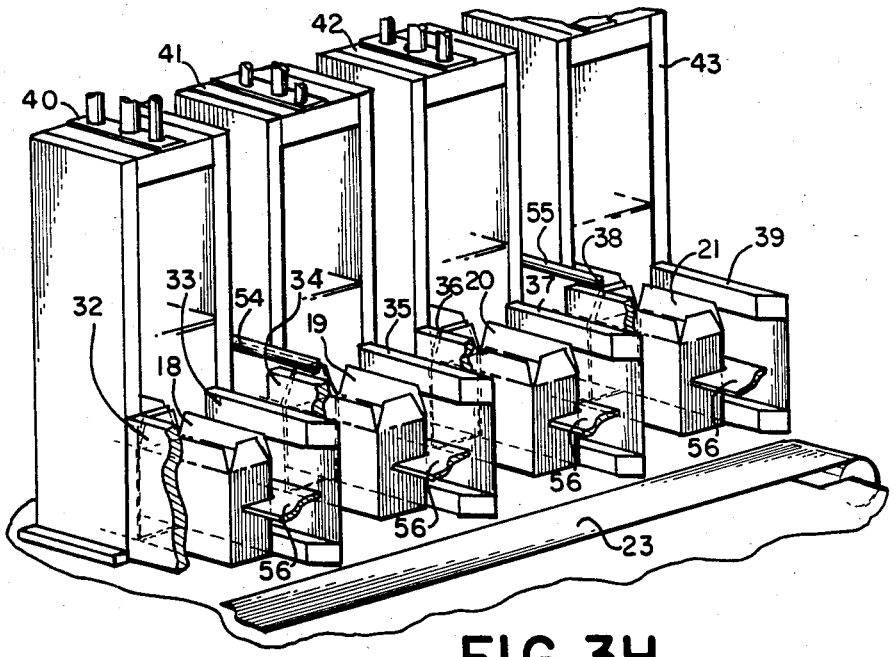
Figure 3I:
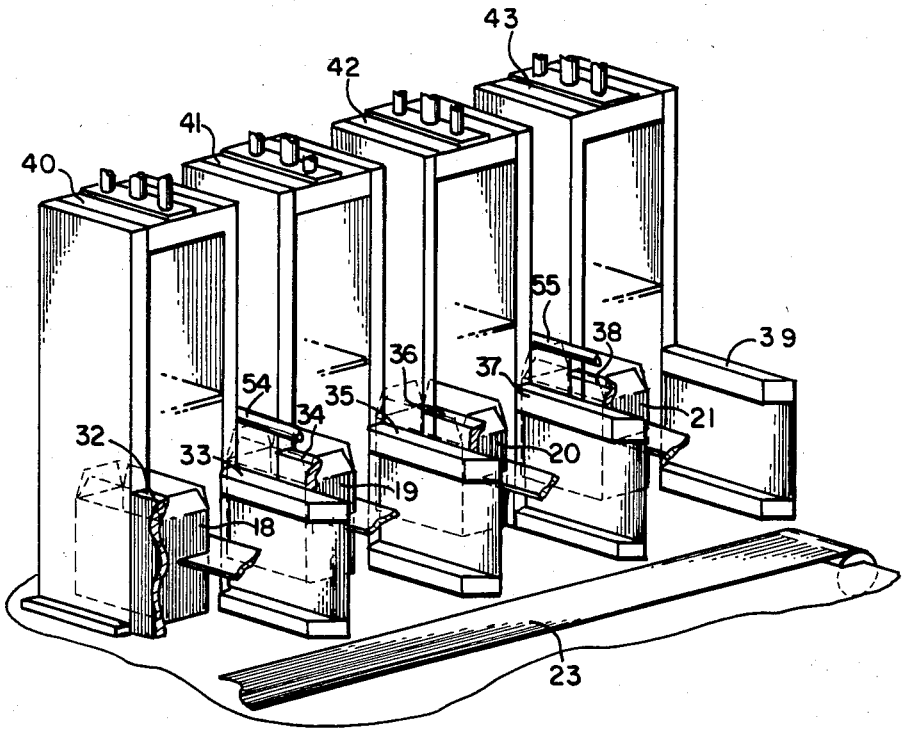

As is shown in FIG. 3E, indexing plate 53 moves on rods 54 and 55 to move the boxes toward the loading machines. As this is done, one of the notches 56*a*–56*d* in plates 56 catches the corner of the box. The movement across the conveyor by the indexing plate, coupled with the continued motion of the indexing conveyor, turn the boxes from a position with a lengthwise orientation along the indexing conveyor 23 to a lengthwise orientation across the indexing conveyor as shown in FIGS. 3F–3G. FIG. 3H shows the boxes in the indexing position in front of the loading machines 40–43. A count of bags loaded into each box is made. Upon a count of 75 or 150, the indexer plate 53 is moved in a rapid motion to push the boxes from the index positions to positions under the loading machines. This is shown in FIG. 3I. A spring loaded brake shoe is embedded in rails 33, 35, 37 and 39 at the location of the boxes under the loading machines. This retards the rapid motion of the boxes so they stop under the loading machine.

Figure 3J:
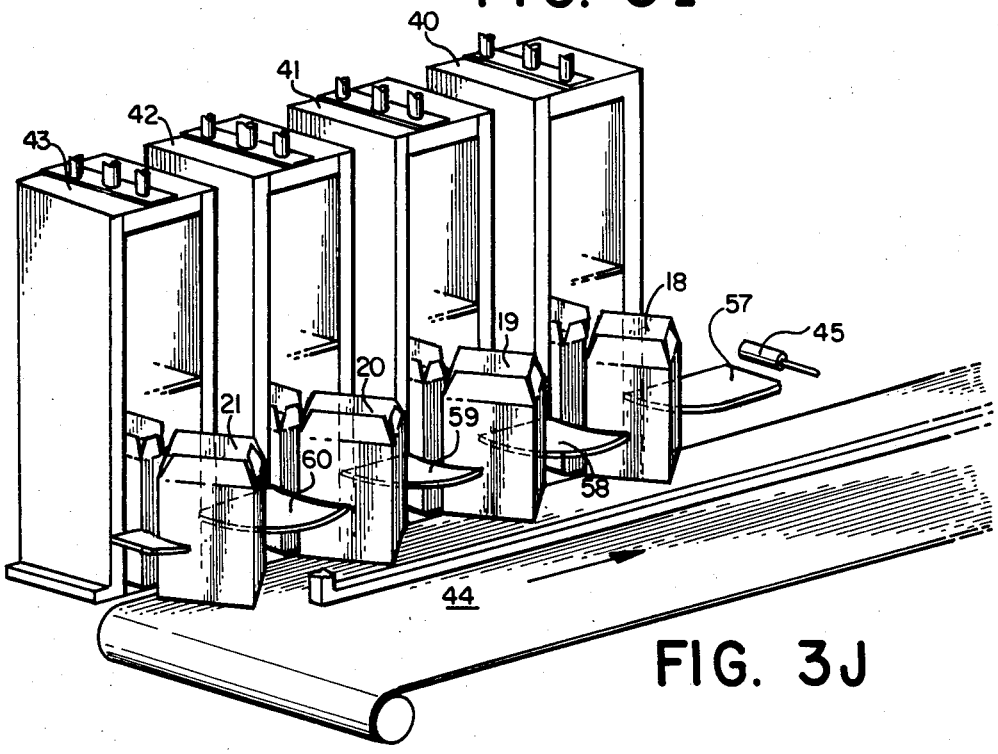
Figure 3K:
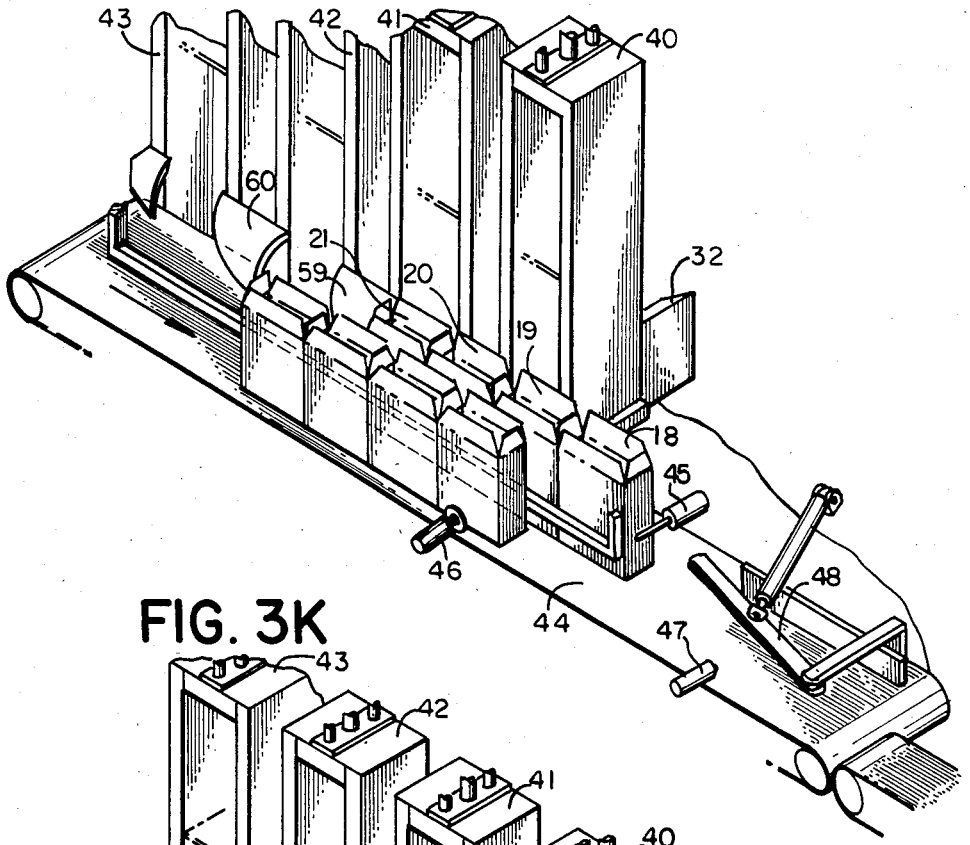

Simultaneously, the loaded boxes are pushed from under the loading machines and on to the full box conveyor 44, as shown in FIG. 3J, a view from the other side of the table. Turning plates 57–60 have a curved surface which cooperates with the movement of the full carton conveyor 44 to turn the boxes to a lengthwise orientation along the conveyor 44 as is shown in FIG. 3K. When the boxes come out of the loading machines, they are blocked from further movement by blocker 45 as is shown in FIG. 3K.

Figure 3L:
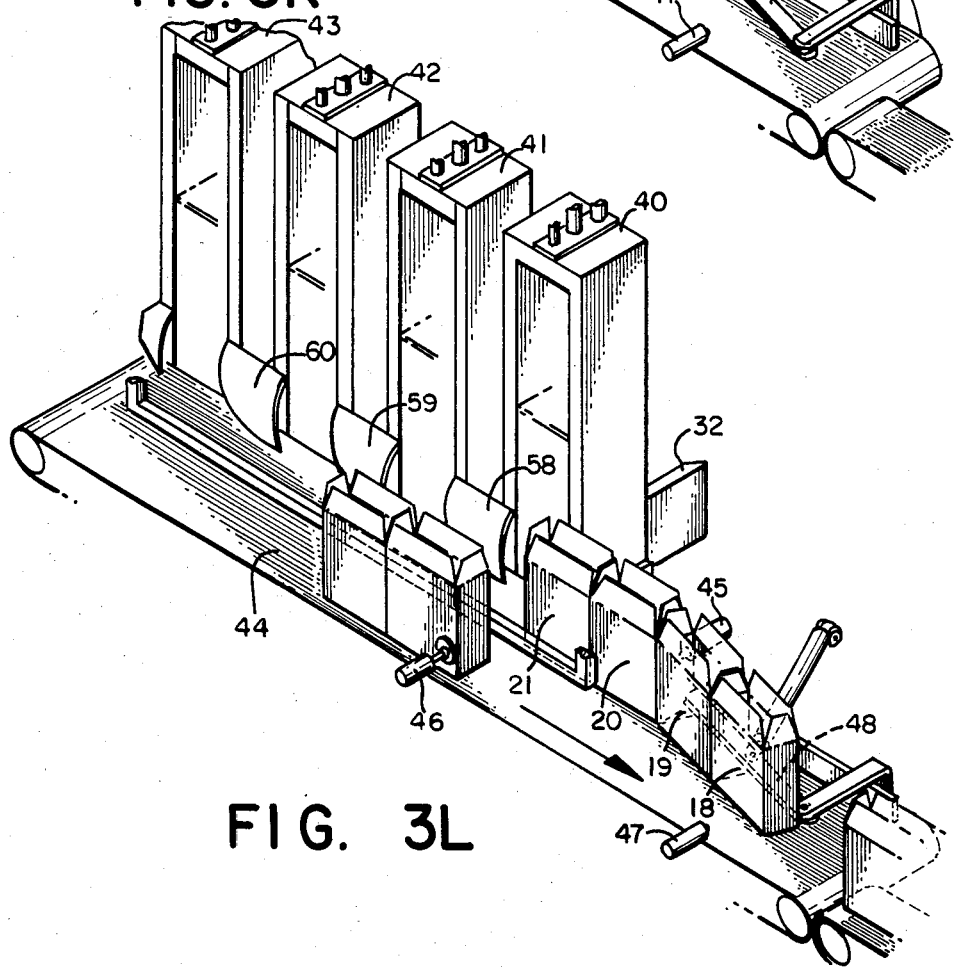

The squeezer 46 stops the boxes on the full box conveyor 44. When the optical sensor 47 senses that the portion of the full box conveyor 44 in front of the sensor is free of boxes, the blocker 45 is withdrawn and the boxes merge into the line of full cartons as is shown in FIG. 3L.

Figure 4:
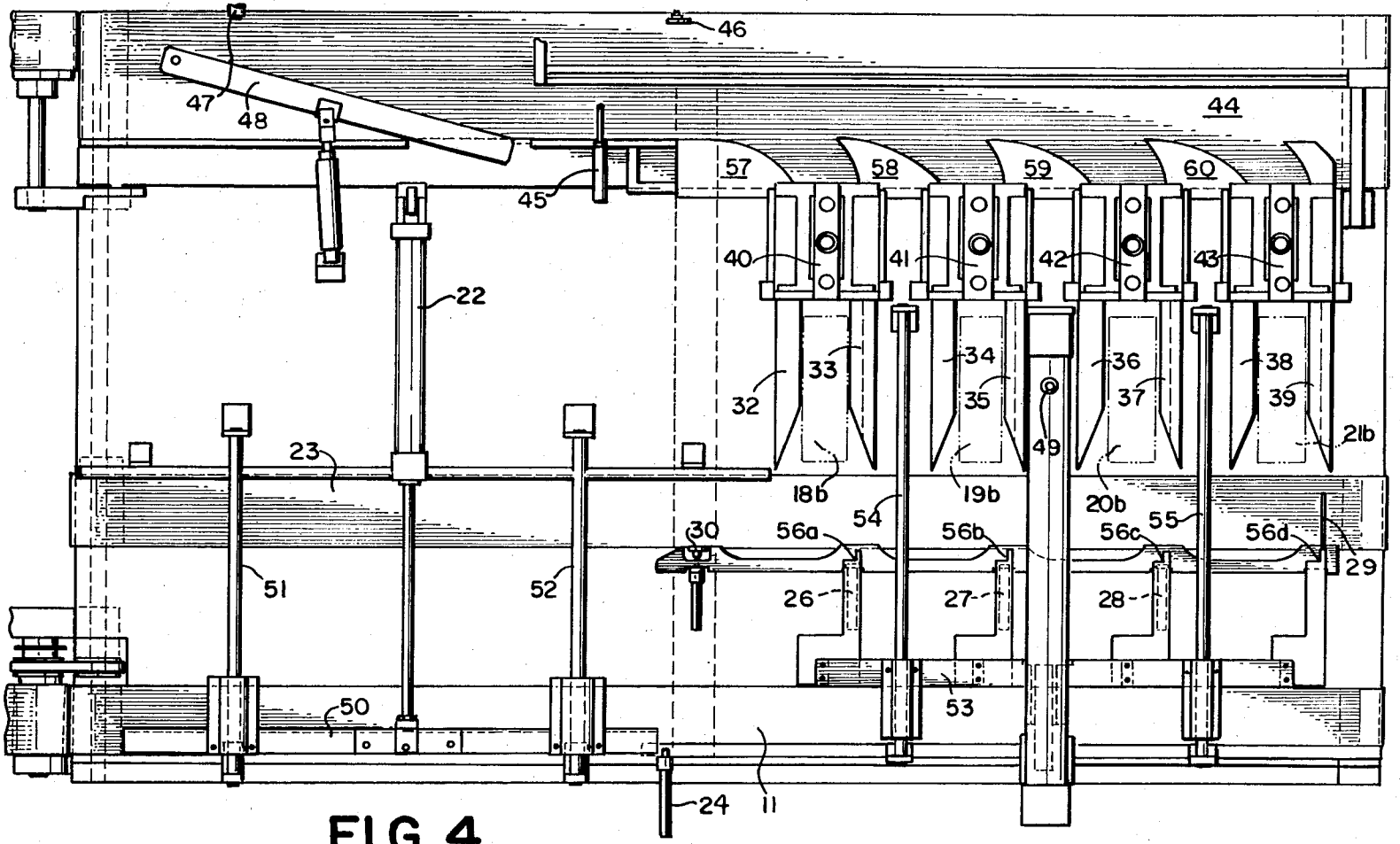
FIG. 4 is a top plan view of the indexing table.
Figure 5:
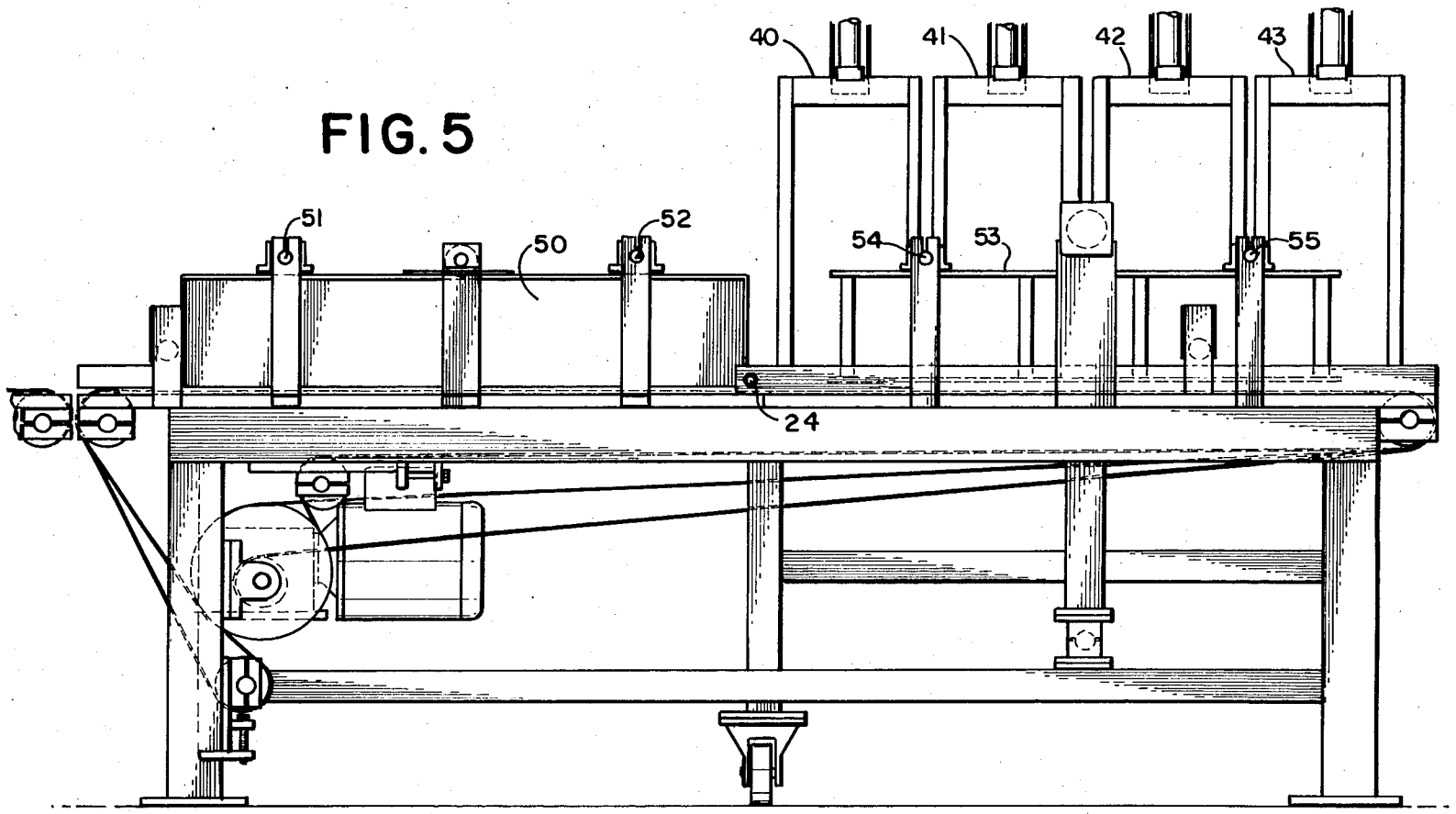
FIG. 5 is a front view of the indexing table.

FIGS. 4 and 5 are plane and front elevation views of the table. They show the elements which have just been described in more precise detail.

The operation of the table is controlled by a microprocessor in a sequence depicted by FIGS. 3A–3L.

While a particular embodiment of the invention has been shown and described, various modifications are within the true spirit and scope of the invention. The appended claims are, therefore, intended to cover all such modifications.

I claim:

1. An indexing table for delivering boxes to and from box loading machines, comprising:

a main conveyor traversing said indexing table for transporting empty boxes along said indexing table;

an indexing conveyor parallel to said main conveyor for transporting empty boxes to a loading machine for said table;

a pusher for sequentially pushing groups of said boxes from said main line conveyor onto said indexing conveyor;

a plurality of loading machines along said indexing conveyor, one for each box in a group;

an indexer for aligning one box at each of said loading machines;

a full box conveyor parallel to said main and indexing conveyors, and on the opposite side of said loading machines, for transporting loading boxes from said machines along said table; and means for merging loaded boxes from said machines on said table with a line of loaded boxes on said full box conveyor.

2. A plurality of indexing tables as recited in claim 1 in a system comprising a box-forming machine, and a box-closing machine, said main conveyor and said full box conveyor being continuous from table to table so that said box-forming machine and said box-closing machine service a plurality of indexing tables.

3. The indexing table recited in claim 1 further comprising a separator on said indexing conveyor between said pusher and said indexer for separating the boxes of a group on said conveyor.

4. The indexing table recited in claim 4 wherein said separator comprises:

a blocker selectively actuated in response to the speed of said conveyor belt for stopping the movement of a box in the front of one of a plurality of said loading machines.

5. The indexing table recited in claim 3 wherein said separator comprises:

a squeezing mechanism which is selectively actuated in response to the speed of movement of said indexing belt for holding one of said boxes stationary until it is properly spaced from another box in said group.

6. The indexing table recited in claim 1 further comprising an optical sensor on said main conveyor, said pusher being responsive to said optical sensor for pushing said groups of boxes from said main conveyor onto said indexing conveyor.

7. The indexing table recited in claim 1 wherein said indexer comprises an index plate which moves across said indexing conveyor, and notches in said plate, the movement of said plate and the movement of said indexing conveyor turning said boxes from a lengthwise orientation along said indexing conveyor to a lengthwise orientation across said indexing conveyor.

8. The indexing table recited in claim 1 further comprising:

rails which extend from said indexer beneath said plurality of loading machines, said indexer moving each box of a group between the rails of one loading machine.

9. The indexing table recited in claim 9 wherein said indexer moves said group of boxes to an index position in front of said loading machine and then moves said boxes under said loading machines for loading.

10. The indexing table recited in claim 10 wherein the movement of said boxes from said index positions to a position under said loading machines pushes loaded boxes onto said full box conveyor.

11. The indexing table recited in claim 11 further comprising turning plates on said full box conveyor, said turning plates having a curvature which turns said boxes from a lengthwise orientation across said conveyor to a lengthwise orientation along said full box conveyor.

12. The indexing table recited in claim 1 wherein said means for merging comprises:

a squeezing mechanism for holding said line of loaded boxes in said full box conveyor; and a blocker mechanism for holding full boxes from the loading machines on said indexing table until said full box conveyor is clear.

13. The indexing table recited in claim 13 further comprising:

an optical sensing device for sensing the absence of loaded boxes on said full box conveyor, said blocker mechanism releasing said full boxes from the loading machines in response to said optical sensing device.

* * * * *